US010582818B2

(12) United States Patent
Kang

(10) Patent No.: US 10,582,818 B2
(45) Date of Patent: Mar. 10, 2020

(54) CLEANING ASSEMBLY

(71) Applicant: Hee Young Kang, Chonan-shi (KR)

(72) Inventor: Hee Young Kang, Chonan-shi (KR)

( * ) Notice: Subject to any disclaimer, the term of this patent is extended or adjusted under 35 U.S.C. 154(b) by 85 days.

(21) Appl. No.: 15/992,417

(22) Filed: May 30, 2018

(65) Prior Publication Data

US 2018/0353022 A1 Dec. 13, 2018

(30) Foreign Application Priority Data

Jun. 7, 2017 (KR) ..... 10-2017-0071018

(51) Int. Cl.
*A47L 1/12* (2006.01)
*H01F 7/02* (2006.01)

(52) U.S. Cl.
CPC ..... *A47L 1/12* (2013.01); *H01F 7/0221* (2013.01); *H01F 7/0252* (2013.01)

(58) Field of Classification Search
CPC ..... A47L 1/12; H01F 7/0252; H01F 7/0221
See application file for complete search history.

(56) References Cited

U.S. PATENT DOCUMENTS 2,634,444 A * 4/1953 Coleman ..... A47L 1/12 15/220.2
3,296,645 A * 1/1967 Shore ..... A47L 1/12 15/220.2
3,609,793 A * 10/1971 Kaftan ..... A47L 1/12 15/220.2
3,731,337 A * 5/1973 Doyel ..... A47L 1/12 15/220.2
3,751,750 A * 8/1973 Kaftan ..... A47L 1/12 15/220.2
5,515,570 A * 5/1996 Muscroft ..... A47L 1/12 15/210.1
6,206,978 B1 * 3/2001 Tsui ..... A01K 63/04 119/245
9,215,956 B2 * 12/2015 Ryu ..... A47L 1/03
2013/0056028 A1 * 3/2013 Ryu ..... A47L 1/03 134/6

(Continued)

FOREIGN PATENT DOCUMENTS

KR 101241250 B1 * 3/2013 ..... A47L 1/03
KR 10-2013-0042684 4/2013
KR 20130133999 A * 12/2013

*Primary Examiner* — Marc Carlson
(74) *Attorney, Agent, or Firm* — Kile Park Reed & Houtteman PLLC

(57) ABSTRACT

A cleaning assembly cleans a multi layered glass window having at least two glasses forming an internal space. The cleaning assembly includes an internal magnetic body and an outer magnetic body. The internal magnetic body is disposed in the internal space of the glass window. The internal magnetic body includes an internal magnetic module including two or more pair of magnetic parts spaced apart from each other, a housing receiving each of the internal magnetic modules, and a bracket forming each of the housings as one structure, the pair of magnetic parts including two magnets facing each other by repulsion. The outer magnetic body includes an outer magnetic module attracted with the internal magnetic module, and a cleaning part surface contacted with an outer surface of the glass window by the attraction to clean the outer surface of the glass window corresponding to the outer magnetic module.

3 Claims, 3 Drawing Sheets

(56) References Cited

U.S. PATENT DOCUMENTS

2014/0332030 A1* 11/2014 Trudeau ..... A47L 1/09
134/6
2015/0027494 A1* 1/2015 Ryu ..... A47L 1/03
134/6

* cited by examiner

CLEANING ASSEMBLY

CROSS-REFERENCE TO RELATED APPLICATIONS

This application claims priority under 35 U.S.C. § 119 to Korean Patent Application No. 10-2017-0071018, filed on Jun. 7, 2017 in the Korean Intellectual Property Office (KIPO), the contents of which are herein incorporated by reference in their entirety.

BACKGROUND OF THE INVENTION

1. Technical Field

Exemplary embodiments of the present invention relate to a cleaning assembly. More particularly, exemplary embodiments of the present invention relate to a cleaning assembly for cleaning a multi layered glass window having at least two glasses forming an internal space therebetween.

2. Description of the Related Art

When a double layered glass window having at least two glasses forming an internal space therebetween is cleaned, a cleaning assembly including a magnetic module surface-contacting both outer surfaces of the glass window by attraction may be used. Examples of the above-mentioned cleaning assembly are disclosed in Korean laid open patent No. 10-2013-0042684.

However, when the double layered glass window is cleaned using the above-mentioned cleaning assembly, the magnetic module attracts both outer surfaces of the glasses toward a center of the glass window, and thus, the glass may be broken. Also, in order to increase adhesion of a cleaning member, size of the magnetic module is increased. When the magnetic module includes electric magnets, the structure of the cleaning assembly may be too complex.

SUMMARY

Exemplary embodiments of the present invention provide a cleaning assembly capable of more safely cleaning a multi layered glass window.

According to one aspect of the present invention, a cleaning assembly cleans a multi layered glass window having at least two glasses forming an internal space. The cleaning assembly includes an internal magnetic body and an outer magnetic body. The internal magnetic body is disposed in the internal space of the glass window. The internal magnetic body includes an internal magnetic module including two or more pair of magnetic parts spaced apart from each other, a housing receiving each of the internal magnetic modules, and a bracket forming each of the housings as one structure, the pair of magnetic parts including two magnets facing each other by repulsion. The outer magnetic body includes an outer magnetic module attracted with the internal magnetic module, and a cleaning part surface contacted with an outer surface of the glass window by the attraction to clean the outer surface of the glass window corresponding to the outer magnetic module.

In an exemplary embodiment of the present invention, the glass window may have a curved glass, and the bracket includes a flexible material.

In an exemplary embodiment of the present invention, the cleaning assembly may further include two outer magnetic bodies surface contacting both outer surfaces of the glass window.

BRIEF DESCRIPTION OF THE DRAWINGS

The above and other features and aspects of the present invention will become more apparent by describing in detailed exemplary embodiments thereof with reference to the accompanying drawings, in which.

DETAILED DESCRIPTION OF THE INVENTION

Figure 1:
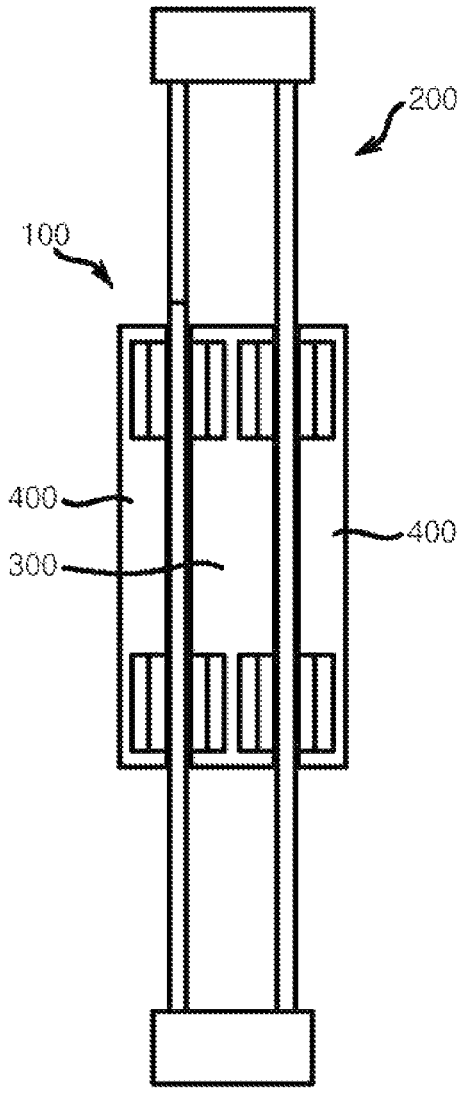
FIG. 1 is a cross-sectional view illustrating a cleaning assembly for cleaning a multi layered glass window according to an exemplary embodiment of the present invention.

The present invention is described more fully hereinafter with reference to the accompanying drawings, in which exemplary embodiments of the present invention are shown. The present invention may, however, be embodied in many different forms and should not be construed as limited to the exemplary embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular exemplary embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a cross-sectional view illustrating a cleaning assembly for cleaning a multi layered glass window according to an exemplary embodiment of the present invention.

Referring to FIG. 1, the cleaning assembly 100 cleans a glass window 200. The glass window 200 has a multi layered structure including at least two glasses forming an internal space therebetween. The cleaning assembly 100 cleans both outer surfaces of the multi layered glass window 200. The multi layered glass window 200 includes at least two glasses. The glass window may also have a double layered glass window, a triple layered glass window, etc.

In the embodiment of the present invention, the cleaning assembly 100 includes an internal magnetic body 300 and an outer magnetic body 400. The internal magnetic body 300 is disposed in an internal space of the multi layered glass window 200. The outer magnetic body 400 is disposed on an outer surface of the multi layered glass window 200.

When the multi layered glass window 200 has the double layered structure, the internal magnetic body 300 is disposed in one internal space formed by two glasses. When the multi layered glass window 200 has the triple layered structure, two internal magnetic bodies may be disposed in two internal spaces formed by three glasses. The internal magnetic body 300 may be inserted into the internal space during manufacturing the multi layered glass window 200.

In another embodiment of the present invention, argon gas etc., may be injected into the internal space of the multi layered glass window 200, and cleaning of internal surfaces of the glass window 200 may be unnecessary. The cleaning assembly 100 includes the outer magnetic body 400 to clean the outer surface of the glass window 200. Alternatively, two outer magnetic bodies may be disposed on both outer surfaces of the glass window 200.

Hereinafter, the internal magnetic body 300 of the cleaning assembly 100 will be explained.

Figure 2:
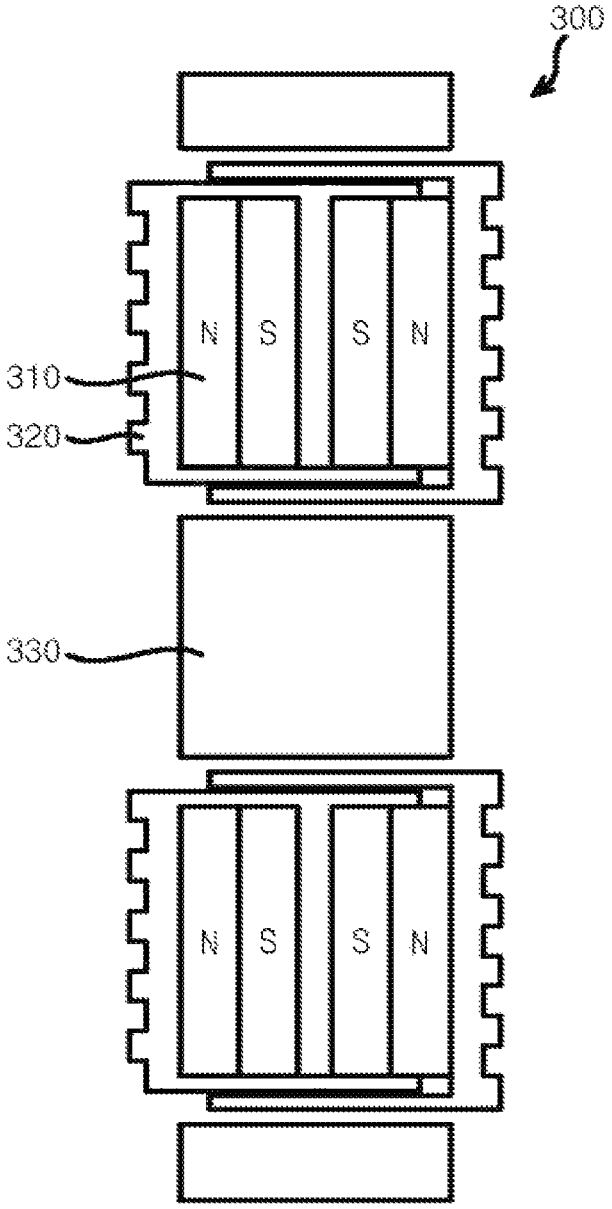
FIG. 2 is a cross-sectional view illustrating an internal magnetic body of the cleaning assembly shown in FIG. 1.

FIG. 2 is a cross-sectional view illustrating an internal magnetic body of the cleaning assembly shown in FIG. 1.

Referring to FIG. 2, the internal magnetic body 300 may include an internal magnetic module 310, a housing 320, and a bracket 330.

The internal magnetic module 310 may include a pair of magnetic parts having two magnets. The pair of magnetic parts may include two magnets facing each other. In the pair of magnetic parts, the two magnets are arranged to form repulsion. The internal magnetic module 310 includes the pair of magnetic parts pushing out each other toward the outer surfaces of the glass window 200. When the two magnets of the internal magnetic module 310 form repulsion each other and communication with the outer magnetic body 400 does not cause inconvenience, the pair of magnetic parts may have various shapes.

When the internal magnetic module 310 does not include the pair of magnetic parts spaced apart from each other but includes integrally formed one magnet part, the internal magnetic module 310 may not easily communicate with the outer magnetic body 400 for cleaning the glass window 200, for example, rotation, various handlings, etc. In the present invention, the internal magnetic module 310 includes the pair of magnetic parts spaced apart from each other. That is, the internal magnetic module 310 includes at least two magnetic parts, which are spaced apart from each other.

The internal magnetic module 310 includes two or more of the pair of magnetic parts facing each other and spaced apart from each other by repulsion.

The housing 320 receives each of the internal magnetic modules 310. In the embodiment of the present invention, one of the housings 320 may be inserted into the other of the housings 320. Thus, the internal magnetic module 310 is received in one of the housings 320, and the one of the housings 320 receiving the internal magnetic module 310 is received in the other of the housings 320. Since the internal magnetic module 310 repulses the housings 320 toward the outside by the repulsion of the pair of the magnetic parts of the internal magnetic module 310, the housings 320 surface contact with internal surfaces of the glass window 200.

According to another embodiment of the present invention, the housing 320 may have embossed patterns to decrease frictional force against inner surfaces of the multi layered glass window 200. Also, the housing 320 may include plastic material having low frictional coefficient to decrease the friction. The plastic material having the low frictional coefficient may include Teflon.

The bracket 330 may be formed to form each of the housings 320 as one structure. That is, the bracket 330 may have a structure, to which the housings 320 are fixed. The bracket 320 may have a fitting structure into which the housings 320 are fitted. The housings 320 may have a rounded corner, and the housings 320, in which the bracket 330 is received, are not rotated, and thus, the bracket 330 may have a rounded corner, in which the housings 320 are received. The bracket 330 is fixed so that both portions of the housings 320 surface contacted with both sides of the multi layered glass window 200.

Recently, the multi layered glass window 200 may be flexible. That is, the glass window may include a curved glass.

The internal magnetic body 300 disposed in the multi layered glass window 200 having the curved glass may also have a curved structure. The bracket 330 of the internal magnetic body 300 may include a flexible material. The bracket 330 may include plastic having low density.

However, when the multi layered glass window does not include the curved glass but includes a flat glass, the bracket may not include the flexible material.

Thus, the internal magnetic body 300 may include the above-mentioned internal magnetic module 310, the housing 320, and the bracket 330, and may be disposed in the internal space of the multi layered glass window 200. In particular, the internal magnetic body 300 may be more securely contacted with both inner surfaces of the multi layered glass window 200.

Hereinafter, the outer magnetic body 400 of the cleaning assembly 100 will be explained.

Figure 3:
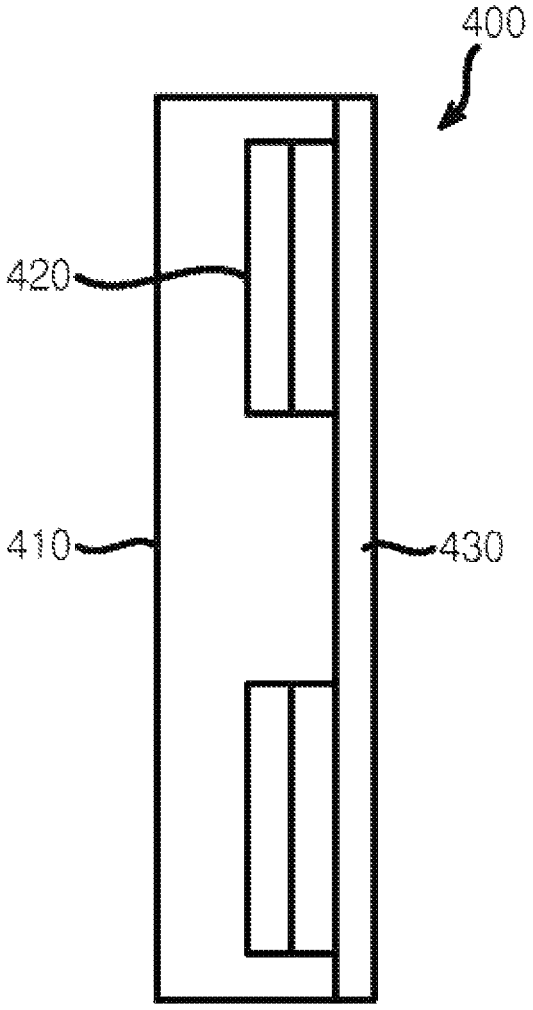
FIG. 3 is a cross-sectional view illustrating an outer magnetic body of the cleaning assembly shown in FIG. 1.

FIG. 3 is a cross-sectional view illustrating an outer magnetic body of the cleaning assembly shown in FIG. 1.

Referring to FIG. 3, the outer magnetic body 400 may include an outer magnetic module 420 and a cleaning part 430.

The outer magnetic module 420 may include a magnetic part and a supporting part 410 for supporting the magnetic part. The outer magnetic module 420 may be attracted with the internal magnetic module 310. The outer magnetic module 420 may be combined with the internal magnetic module 310 by attraction to interpose the multi layered glass window 200. The outer magnetic module 420 may include at least two magnetic parts, like the internal magnetic module 310.

In particular, the outer magnetic body 400 may be disposed outside from both sides of the multi layered glass window 200. Thus, the both outer sides of the multi layered glass window 200 may be cleaned.

The cleaning part 430 may include the outer magnetic module 420 surface contacted with the outer surfaces of the glass window 200 by the attraction between the internal magnetic body 300 and the outer magnetic body 400. That is, the cleaning part 430 may rub the outer surface of the multi layered glass window 200. When the cleaning part 430 includes a material for cleaning the surface of the glass, the cleaning part 430 may include various materials.

In the conventional cleaning assembly, only the outer magnetic modules are contacted with the outer surfaces of the glass window 200 towards inside of the glass window 200, and the multi layered glass window 200 is only attracted inwardly, and thus, the glass window 200 may be damaged during cleaning the multi layered glass window 200. However, the cleaning assembly 100 including the internal magnetic body 300 and the outer magnetic body 400 may further have adhesion from the inside of the multi layered glass window 200 toward the outer surface of the glass window 200, and the outer magnetic body 400 is attracted toward the inside of the glass window 200 from the outside, and thus, the multi layered glass window 20 may be securely cleaned.

Also, although not shown in figures, when the outer magnetic bodies 400 are disposed on both sides of the multi layered glass window 200, the window opened by rotation may be disposed on each of both sides of the outer magnetic bodies 400. Thus, water, detergent, etc., for cleaning the multi layered glass window 200 may be supplied to the cleaning part 430 through the window.

Also, the cleaning assembly 100 may be applied to a solar panel module, etc., which includes a glass panel. Thus, efficiency of power generation by the solar energy may be improved.

According to the embodiments of the present invention, the cleaning assembly includes the internal magnetic body disposed in the internal space of the double layered glass window. When the glass window is cleaned, the internal magnetic body may relieve attraction force toward the inside from the outside of the glass window.

When the cleaning assembly is used, although the attraction is applied to the outer surfaces of the glass window toward the center of the glass window, the double layered glass window may be more safely cleaned by the internal magnetic body.

Also, the internal magnetic body includes the magnetic module, the housing, and the bracket, and thus, the cleaning assembly may have simple structure.

Since the cleaning assembly cleans the multi layered glass window more securely, safety during cleaning glass windows of a skyscraper may be improved. Also, since the cleaning assembly has a simple structure, the cleaning assembly may be used in various fields.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A cleaning assembly for cleaning a multi layered glass window having at least two glasses forming an internal space, comprising:

an internal magnetic body disposed in the internal space of the glass window, the internal magnetic body including an internal magnetic module including two or more pair of magnetic parts spaced apart from each other, a housing receiving each of the internal magnetic modules, and a bracket forming each of the housings as one structure, the pair of magnetic parts including two magnets facing each other by repulsion; and an outer magnetic body including an outer magnetic module attracted with the internal magnetic module, and a cleaning part surface contacted with an outer surface of the glass window by the attraction to clean the outer surface of the glass window corresponding to the outer magnetic module.

2. The cleaning assembly of claim 1, wherein the glass window has a curved glass, and the bracket includes a flexible material.

3. The cleaning assembly of claim 1, further comprising two outer magnetic bodies surface contacting both outer surfaces of the glass window.

* * * * *